US009816334B2

(12) United States Patent
Wolf

(10) Patent No.: US 9,816,334 B2
(45) Date of Patent: Nov. 14, 2017

(54) PROCESS AND APPARATUS FOR FORMING A COIL OF SCRAP TUBING

(71) Applicant: Clifton E. Wolf, Houston, TX (US)

(72) Inventor: Clifton E. Wolf, Houston, TX (US)

( * ) Notice: Subject to any disclaimer, the term of this patent is extended or adjusted under 35 U.S.C. 154(b) by 0 days.

(21) Appl. No.: 15/180,723

(22) Filed: Jun. 13, 2016

(65) Prior Publication Data

US 2016/0368730 A1 Dec. 22, 2016

(51) Int. Cl.

| | |
|---|---|
| ***B21C 47/24*** | (2006.01) |
| ***B21C 47/12*** | (2006.01) |
| ***B65H 67/04*** | (2006.01) |
| ***B21C 47/30*** | (2006.01) |
| ***B21C 37/04*** | (2006.01) |
| ***B65H 54/58*** | (2006.01) |
| ***E21B 19/22*** | (2006.01) |
| ***E21B 19/00*** | (2006.01) |

(52) U.S. Cl.

CPC ..... *E21B 19/22* (2013.01); *B21C 37/04* (2013.01); *B21C 47/12* (2013.01); *B21C 47/24* (2013.01); *B21C 47/30* (2013.01); *B65H 54/58* (2013.01); *B65H 67/0411* (2013.01); *E21B 19/008* (2013.01); *B65H 2701/33* (2013.01)

(58) Field of Classification Search

CPC .... B65H 54/04; B65H 54/58; B65H 67/0411; B65H 73/00; B21C 47/12; B21C 47/24

USPC ..... 242/472.5

See application file for complete search history.

(56) References Cited

U.S. PATENT DOCUMENTS

2012/0110955 A1* 5/2012 Rekieta ..... B65B 63/04 53/430

FOREIGN PATENT DOCUMENTS

IT WO 2004108317 A1 * 12/2004 ..... B21C 47/06

* cited by examiner

*Primary Examiner* — William E Dondero

(74) *Attorney, Agent, or Firm* — Egbert Law Offices, PLLC

(57) ABSTRACT

A process for forming a coil of scrap tubing includes the steps of forming a turntable having at least one longitudinal member extending upwardly therefrom, extending a length of the tubing to the turntable, rotating the turntable such that the tubing wraps around the longitudinal member so as to form the coil, and lifting the coil from the turntable that above the longitudinal member. An end of the scrap tubing from the reel is fixed to the turntable prior to the step of rotating. The longitudinal member includes a panel extending upwardly from the turntable and an arm pivotally mounted adjacent an end of the panel opposite the turntable. A forklift is used to lift the coil from the turntable.

4 Claims, 5 Drawing Sheets

PROCESS AND APPARATUS FOR FORMING A COIL OF SCRAP TUBING

CROSS-REFERENCE TO RELATED APPLICATIONS

The present application is a continuation-in-part of U.S. patent application Ser. No. 14/534,787, filed on Nov. 6, 2014, and entitled "Process and Apparatus for Forming a Coil Scrap Tubing", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to coiled tubing. More particularly, the present invention relates to apparatus and processes for forming a coil of scrap tubing. Additionally, the present invention relates to processes and apparatus whereby a coil of scrap tubing can be formed and provided without the need for a spool.

2. Description of Related Art Including Information Disclosed Under 37 CFR 1.97 and 37 CFR 1.98

Coiled tubing is a term referred to metal piping that is used in the oil and gas drilling industry. Coiled tubing is a metal pipe that usually comes in small sizes, varying from less than one inch to several inches in outer diameter. Because of its small size, coiled tubing is bendable. This is contrast to conventional drilling tubulars which are larger in outer diameter and not flexible. Because it is bendable, coiled tubing is stored on a spool prior to and after its use. A spool can typically hold great lengths of coiled tubing, with some lengths of reaching even over a mile of coiled tubing on one single spool. On advantage of coiled tubing over traditional drilling tubulars is that the entire length stored on a spool is continuous. This is contrast to traditional drilling tubular that come in sixty to ninety foot increments and must be patched end-to-end while drilling.

Coiled tubing has many uses. Coiled tubing can be used to circulate fluid within a wellbore. It may also be used to pump a fluid to a specific location in a well for purposes such as cementing perforations in a wellbore or performing chemical washes of downhole components. Coiled tubing can also be used for drilling a well. A drillbit can be attached to an end of the coiled tubing and the coiled tubing is pushed into the ground so as to drill a wellbore for a well.

As a result of the many uses of coiled tubing, it is used frequently within the oil and gas well drilling industry. One problem associated with the use of coiled tubing in the oil and gas industry is that disposal of used coiled tubing. Normally, used coiled tubing is wound back around a spool. The spool is then taken to a disposal location, the spool is simply left at that location. Thus, after disposal there is normally no further utilization of coiled tubing. Because used coiled tubing is almost never utilized once it is used, it because a worthless scrap metal. Scrap coiled tubing becomes a financial burden on oil and gas drilling companies because not only is the scrap coiled tubing worthless, it is useless and requires additional costs for its disposal.

One of the problems with the disposal of the scrap tubing is the expense of the reel upon which the scrap tubing is placed after the tubing has exceeded its life expectancy. Typically, the oil and gas production company will simply wrap the coiled tubing around a reel for an extended length. Since the cost of the reel can be up to $15,000, it is not practical to dispose of the coiled tubing after it is been wrapped around the reel. Typically, the reel and the scrap tubing is maintained in storage for an extended time. Ultimately, the tubing should be removed from the reel prior to disposal. This avoids the cost of the lost reel.

In prior U.S. Pat. No. 7,958,762, issued to the present inventor on Jun. 14, 2011, the scrap coiled tubing was formed into a length of straight tubing. The straight scrap coil is then utilized in the cattle and ranching industries for the purposes of continuous fences and cattleguards. As such, the scrap coiled tubing was actually repurposed for another use.

In other circumstances, it is simply desirable to provide the scrapped coiled tubing for recycling. Typically, at present values, the scrap tubing will be worth fifteen dollars per pound. If it were possible to provide the scrapped tubing without the use of a spool or reel, then the economic benefit to the recycler or to the scrapper would be significantly improved. As such, a need has developed so as to provide the scrap tubing in a compact form without a spool or reel so that the scrap coiled tubing can maximize returns to the scrapper or recycler.

In the past, various patents have issued relating to techniques for coiling tubing. For example, U.S. Pat. No. 3,605,541, issued on Sep. 20, 1971 to Ruben et al., describes a method for rotary shear and scrap preparation of tubing. Elongated scrap material to be cut to length is fed radially inwardly toward the axis of rotation of a drum between a fixed blade and the drum mounted blade. A cutting force is uniform across the full length of the cutting blades. Material feed is controlled both as to speed and presentation. The rotary drum sweeps cut material toward discharge means.

U.S. Pat. No. 6,264,128, issued on Jul. 24, 2001 to Shampine et al., discloses a levelwind system for a coiled tubing reel. The levelwind system includes an arcuate guide arm extending over the upper surface of the reel. A universal joint mounts the lower end of the arm for pivotal movement both vertically and horizontally. A guide member is supported on the free end of the guide arm for guiding the coiled tubing to an on-and-off reel. A hydraulic fluid circuit is responsive to a position sensor and a microprocessor for controlling the movement of the coiled tubing guide arm.

U.S. Pat. No. 6,435,447, issued on Aug. 20, 2002 to Coats et al., describes a coiled tubing winding tool. This winding tool is operable in conjunction with a levelwind so as to spool coiled tubing into a helical pattern onto a reel. The winding tool includes a plurality of rollers that are urged against the winds of the coiled tubing with a biasing member. A driver provides controlled oscillatory translational movement for the rollers.

U.S. Pat. No. 6,460,796, issued on Oct. 8, 2002 to Berning et al., discloses a reel for supporting composite coiled tubing. The coiled tubing is wound onto the reel and pressurized for pumping fluid through the coiled tubing into a subterranean well. The wheel includes a portable base, a hub mounted on the base and rotatable about a hub axis, and end flange adjacent to each end of the hub for retaining the coiled tubing on the hub and between the end flanges, and a compliant material covering at least a portion of the exterior surface of the hub for engagement with the coiled tubing. As a result, radially inward compressive forces exerted by the coiled tubing are absorbed by the compliant material.

U.S. Pat. No. 8,393,079, issued on Mar. 12, 2013 to M. A. Parmer, discloses a method for salvaging scrap by initially placing a partially completed coil on a reel. An end of a straight tube that is helically wrapped with a spine being stripped to an end of a partially completed coil is connected to an end of a straight tube. The reel is rotated after completing the connection until the partially completed spin fin coil is complete.

U.S. Patent Publication No. 2011/0167973, published on Jul. 14, 2011 to L. W. Wadsworth, shows an apparatus for cutting tubular members. This apparatus includes a support structure, a control system, the cutting station, a guide, and an extracting assembly. The cutting station includes a first wheel having at least one cutting member located on the circumference of the first wheel and a second wheel having at least one projection located on the circumference of the second wheel. The extracted assembly has a cylindrical member with a first end and a second end.

In the past, when the coils of scrap tubing were formed, it became very difficult to transport the coiled tubing. Under certain circumstances, the coiled tubing would be placed upon expensive reels for the purposes of transport. In other circumstances, once the coiled tubing is created, generally high-powered hoist systems are required so as to lift the coiled tubing upwardly. Ultimately, the lift system would move the coiled tubing to a location and upon the forks of a forklift. The forklift would then transport the coiled tubing for storage or for transport. As such, a need has developed so as to allow a single forklift to effectively transport the coiled tubing from the point of creation of the coiled tubing to the point of storage or transport. Additionally, there is a need to develop a system whereby high-powered hoisting mechanisms are avoided. As such, it is desirable to be able to place the coiling system in a location other than an interior environment which has a hoisting systems.

It is an object of the present invention to provide a process and apparatus that effectively provides a coil of scrap tubing without a reel or a spool connected thereto.

It is another object of the present invention provide a process and apparatus whereby the scrap coiled tubing can be easily formed into a coil.

It is still another object of the present invention provide a process and apparatus that maximizes the return for the delivery of scrap coiled tubing.

It is still further object of the present invention to provide a process and apparatus that simplifies the disposal of scrap coiled tubing.

It is still a further object of the present invention provide a process and apparatus that is easy-to-use, easy to manufacture and relatively inexpensive.

It is still a further object of the present invention to provide a process and apparatus that effectively allows a single forklift to transport the completed coiled tubing from the creation of the coiled tubing to a storage or transport location.

It is still another object of the present invention to provide a process and apparatus whereby complicated hoist systems within indoor environments can be avoided.

These and other objects and advantages of the present invention will become apparent from a reading of the attached specification and appended claims.

BRIEF SUMMARY OF THE INVENTION

The present invention is a process for forming a coil of scrap tubing that comprises the steps of: (1) forming a turntable having at least one longitudinal member extending upwardly therefrom in which the longitudinal member includes a plurality of panels pivotally attached to and extending upwardly from the turntable and a plurality of arms respectively pivotally connected to upper ends of the plurality of panels; (2) applying a reel of the scrap tubing to a location adjacent to the turntable; (3) extending an end of the scrap tubing toward the turntable; (4) fixing the end of the scrap tubing at the turntable; (5) rotating the turntable such that the scrap tubing wraps around the plurality of panels so as to form a coil; (6) pivoting the plurality of panels inwardly in the plurality of arms upwardly after the scrap tubing wraps around the plurality of panels in which the plurality of panels are pivoted from a substantial horizontal orientation to a substantial vertical orientation by the pivoting of the plurality of panels; (7) clamping the scrap tubing in a fixed position; (8) cutting the scrap tubing so as to separate the coil of tubing from a remainder of the scrap tubing; and (9) lifting the coil from the turntable and above the plurality of arms with a forklift after the plurality of arms are in the substantially vertical orientation.

In the process of the present invention, the arm is moved to the substantially horizontal orientation prior to the step of rotating. The process also includes extending the tubing through a levelwind in which the levelwind is positioned adjacent to the turntable, and moving the levelwind while the turntable rotates.

Importantly, the process of the present invention utilizes a single forklift for the moving operations. As such, this process includes the step of inserting the fork of the forklift into a space between the turntable in the bottom of the scrap tubing such that the fork resides beneath the scrap tubing prior to the step of lifting. The turntable will have a coil support extending upwardly therefrom. The turntable is initially rotated such that a bottom of the scrap tubing resides above the top of the turntable on the coil support.

The present invention is also an apparatus for forming a coil of scrap tubing. This apparatus comprises a base, a turntable rotatably mounted upon the base, and at least one longitudinal member extending upwardly from the base. The longitudinal member has an outer surface suitable for allowing the tubing to wrap their around as the turntable rotates.

The turntable has a slotted area therein. The turntable has a clamp positioned adjacent to the slotted area. The clamp is suitable for fixing an end of the tubing to the turntable. The turntable also has a plurality of coil supports extending upwardly from a top surface of the turntable.

The at least one longitudinal member includes a panel extending upwardly from the turntable, and an arm pivotally mounted adjacent and an end of the panel opposite the turntable. The arm is movable between a substantially horizontal orientation and a substantially vertical orientation. The panel is pivotally mounted to the turntable so as to be movable between a vertical position and an inwardly inclined position. An actuator is cooperative with the panel. The actuator is actuatable so as to move the panel between the vertical position and the inwardly inclined position. The arm is in the substantially vertical orientation when the actuator moves the panel to the inwardly inclined position.

The longitudinal member particularly includes a plurality of panels positioned on the turntable so as to generally form chords of a circle, and a plurality of arms respectively pivotally mounted to the plurality of arms. Each of the plurality of arms is movable between a substantially horizontal orientation and a substantially vertical orientation. A plurality of cams are respectively pivotally connected to the plurality of arms. The plurality of cams are respectively cooperative with a surface of the plurality of arms such that it inward movement of the plurality of panels caused the plurality of arms to move toward the substantially vertical orientation.

In the present invention, a levelwind is positioned in spaced relation to the turntable. The levelwind is movable so as to cause the tubing to helically wrap into a coil around the longitudinal members. The winch is positioned in spaced relation to the turntable. The winch is suitable for drawing the tubing across the turntable.

The turntable has a coil support extending upwardly from a top surface of the turntable. This coil support has a thickness dimension. A forklift is provided having at least one fork extending therefrom. The forklift is adapted to lift the coil from the turntable and over a top of the longitudinal member. The fork of the forklift has a thickness less than the thickness dimension of the coil support.

This foregoing Section is intended to describe, with particularity, the preferred embodiment of the present invention. It is understood that modifications to this preferred embodiment can be made within the scope of the present invention. As such, this Section should not to be construed, in any way, as limiting of the broad scope of the present invention. The present invention should only be limited by the following claims and their legal equivalents.

DETAILED DESCRIPTION OF THE INVENTION

Figure 1:
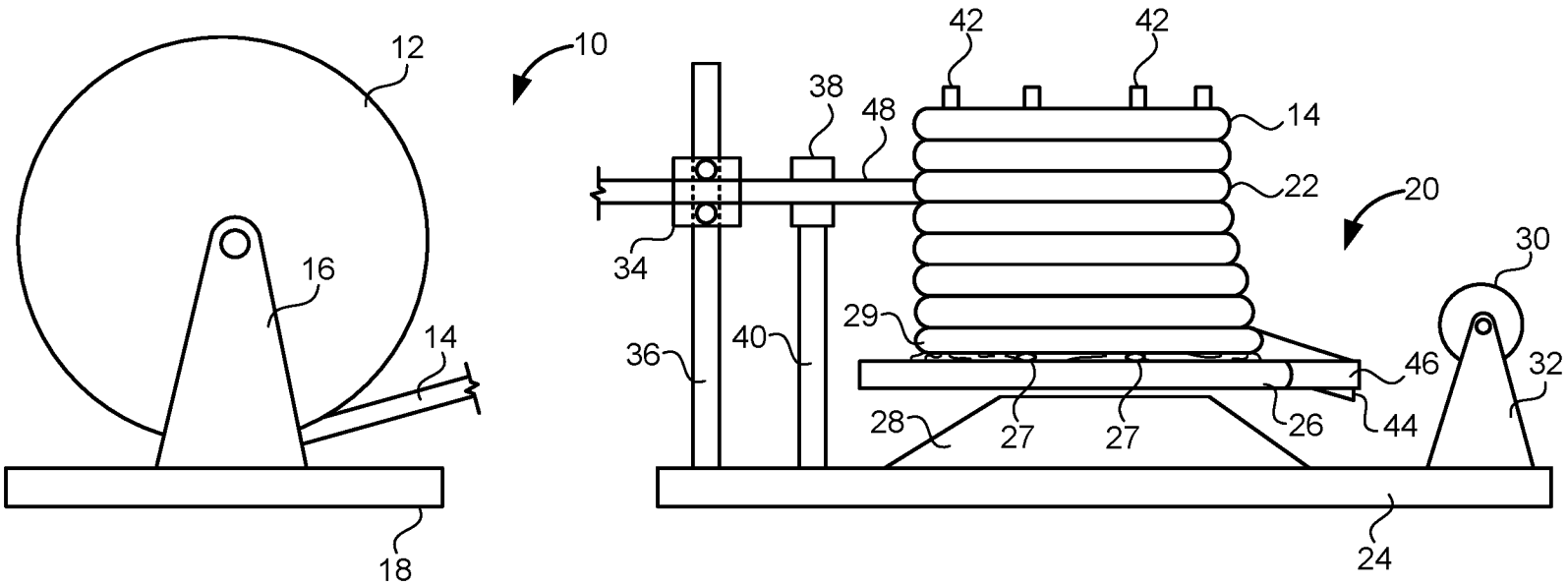
FIG. 1 is a side elevational view showing the process of the present invention for forming a coil of tubing.

Referring to FIG. 1, there is shown the system 10 for the formation of a coil of scrap tubing. In particular, in FIG. 1, it can be seen that there is a reel 12 having scrap tubing 14 wrapped therearound. Reel 12 is rotatably mounted to a frame 16 mounted upon a base 18. The reel 20 is supplied by the oil and gas production company. After the coiled tubing 14 has been used for a period of time and after the coiled tubing 14 exceeds its life expectancy or has become damaged, the oil and gas production company will wrap the scrap tubing around the reel 12. As such, the reel 12 will contain an extremely long length of tubing 14. This large reel 12 of tubing can be delivered by truck or rail to a destination. At the destination, the reel 12 is unloaded from the truck or train and then placed upon the frame 16. As a result, the tubing 14 on the reel 12 can be unwound therefrom.

FIG. 1 illustrates the apparatus 20 of the present invention for forming a coil 22 of the tubing 14. In particular, a base 24 is provided. A turntable 26 is rotatably mounted upon the base 24. The turntable 26 includes a plurality of coil supports 27 that extend upwardly from the top surface of the turntable 26. Each of the coil supports 27 has a thickness dimension so as to provide a space between the bottommost coil 29 of the coil 22 and the top surface of the turntable 26. As such, these coil supports provide a spacing whereby the forks of a forklift can be easily inserted between the bottom of the bottommost coil 29 and the top surface of the turntable 26.

Typically a motor 28 is provided so as to cause the rotary motion of the turntable 26. A winch 30 extends upwardly from the base 24. Winch 30 is supported by a frame 32. A motor can be drivingly connected to the winch 30 so as to cause the requisite rotary motion of the winch 30. Additionally, FIG. 1 shows that there is a levelwind 34 positioned on a post 36 extending upwardly from the base 24. Also, a clamp 38 in the nature of a vise is also provided on a beam 40 extending upwardly from the base 24. The levelwind 34 moves along the post 36 so as to assure an even helical wrapping of the tubing 14 upon the turntable 26.

As can be seen in FIG. 1, and as will be described hereinafter, there are a plurality of longitudinal members 42 extending upwardly from the turntable 26. Longitudinal members 42 are positioned within the interior of the coil 22 so as to provide a structure whereby the coil 22 can be wrapped therearound. The plurality of longitudinal members 42 are created so as to form a temporary spool so that the coil 22 can be formed therearound. After the tubing 14 is properly formed into a coil 22, the longitudinal members 42 can be manipulated so that a forklift can be utilized so as to lift the coil 22 from the turntable 26 and upwardly over the longitudinal members 42. This operation is described in greater detail in association with FIG. 5.

In the process of the present invention, the tubing 14 from the reel 12 can be fastened to a line extending to the winch 30. Typically, holes are formed diametrically through the end of the tubing 14. A suitable fastener can be affixed within these holes. The line is connected to the fastener and connected to the winch 30. The winch 30 can be suitably actuated so as to pull the tubing 14 across the upper surface of the turntable 26 so that an end 44 resides in an area generally beyond the turntable 26. This end 44 can then be released from the winch 30 and moved downwardly so as to be received within the turntable 26 and clamped by clamp 46 thereto. As a result, the rotation of the turntable 26 will cause the tubing 14 to wrap around the longitudinal members 42 into the form of the coil 22.

The tubing 14 can extend through the levelwind 34. During the wrapping of the tubing 14 around the longitudinal members 42, the levelwind 34 can move correspondingly upwardly and downwardly so as to create a helical coil 22. Typically, the levelwind 34 will serve to form a helical pattern of the coil 22 over the longitudinal members 42.

After the coil 42 has been properly formed, the vise 38 is clamped upon the portion 48 of the tubing 14. As a result, the portion 48 will be in a fixed position. The portion 38 can then be cut so as to separate from the remainder of the tubing 14 on the reel 12. The vise 38 will serve to assure that there is no "spring-back" effect. Once portion 48 has been cut, the portion 48 can be tack-welded to the exterior of the coil 22 so as to remain in a fixed position. Additionally, the end 44 can be unclamped from the clamp 46 and moved so as to be tack-welded to the exterior surface of the coil 22.

Ultimately, after this has been completed, a forklift can be provided adjacent to the apparatus 20. Since the forks of the forklift have a thickness dimension less than the thickness dimension of the coil supports 27, the forks can easily enter into the space between the bottommost coil 29 and the top surface of the turntable 26. As such, the forks of the forklift can serve to support the great weight of the coil 26 and to lift the coil 22 over the longitudinal members 42. As a result, the coil 22 can be provided without the need for a spool or reel. As such, the cost of the spool or reel is effectively avoided. Additionally, this allows a single forklift to transport the coil 22 from the apparatus where it is created to a storage or transport location. This configuration and avoids the need for hoisting mechanisms, such as those provided within the interior of a building. As a result, the system 10 of the present invention can actually be located in outdoor environment. No heavy-duty lifting systems, other than the forklift, are required in the present invention.

Figure 2:
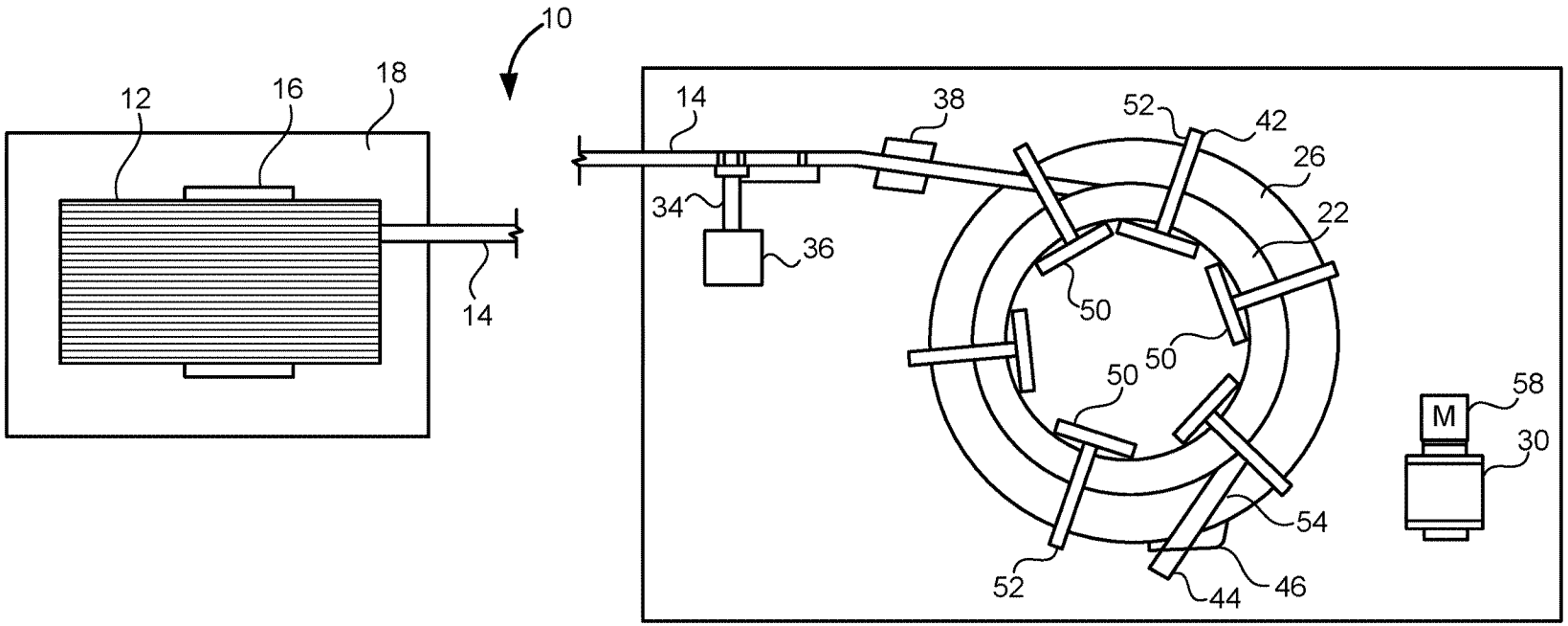
FIG. 2 is a plan view showing the process of the present invention for forming the coiled of tubing.

FIG. 2 shows a plan view of the system 10 of the present invention. In particular, in FIG. 2, the frame 16 is supported upon the base 18. The reel 12 is rotatably mounted within the frame 16. The tubing 14 is illustrated as wrapped around the reel 12. A portion of the tubing 14 and will extend outwardly of the reel 12.

The tubing 14 can extend through the levelwind 34 that is supported by post 36. As such, the tubing 14 can be guided in the desired manner toward the turntable 26. The vise 38 is illustrated as positioned between the levelwind 34 and the turntable 26.

Figure 3:
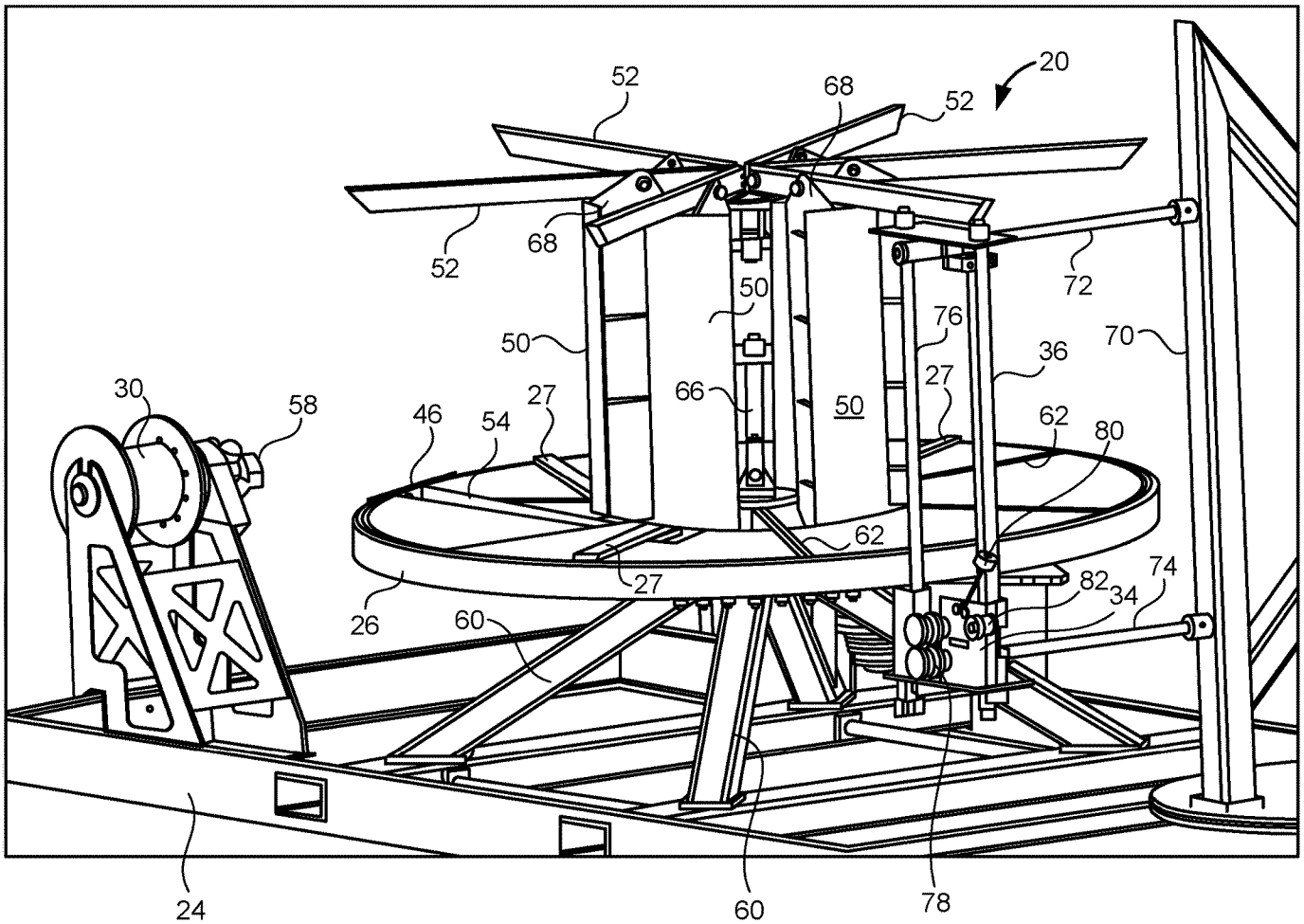
FIG. 3 is a perspective view of the apparatus of the present invention showing the arms in a substantially horizontal orientation.
Figure 4:
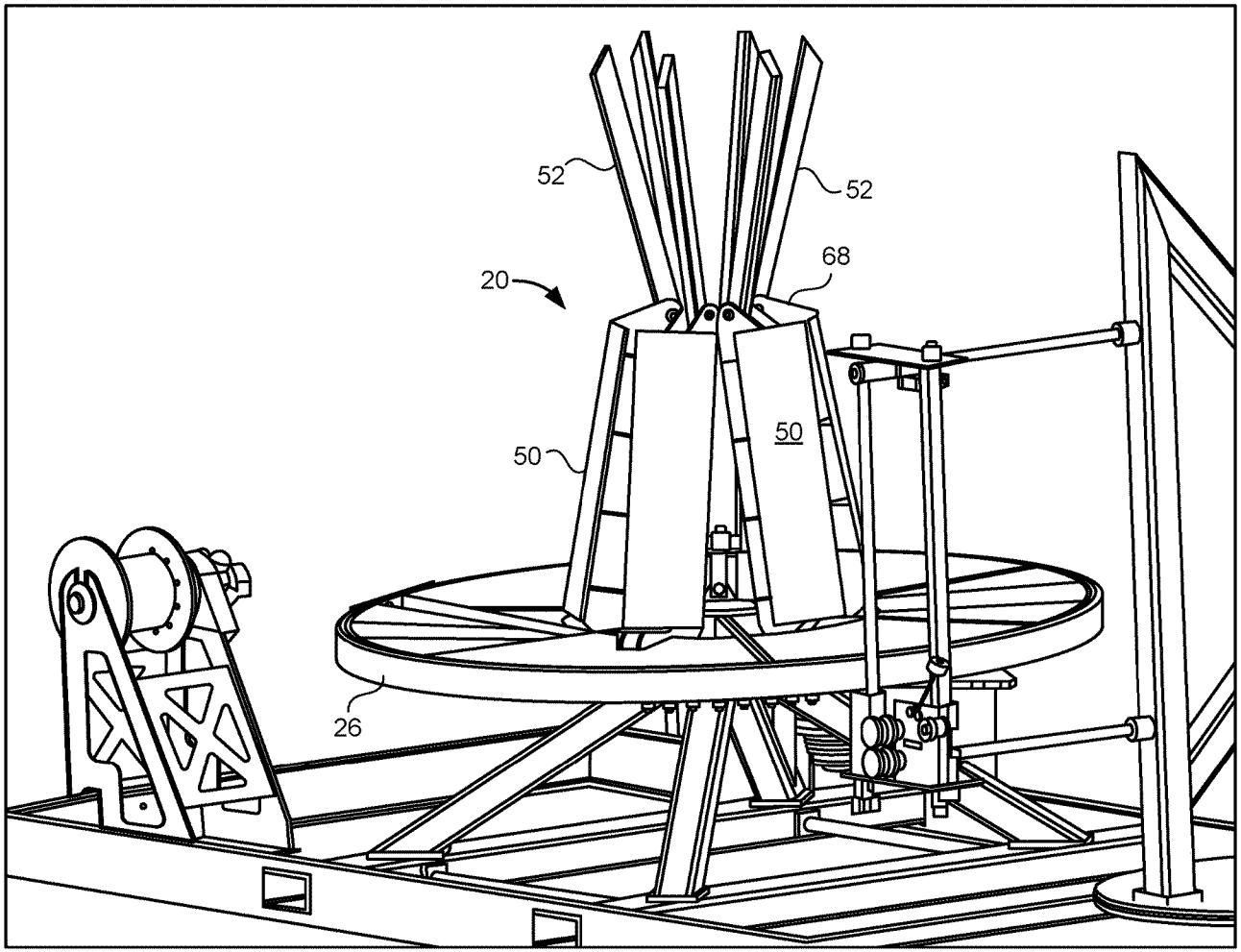
FIG. 4 is a perspective view of the apparatus of the present invention showing the arms in a substantially vertical orientation.

In FIG. 2, it can be seen that the turntable 26 has a generally circular configuration. The longitudinal member 42 is illustrated as having a panel 50 and an arm 52. In particular, a plurality of panels 50 extend upwardly from the turntable 26 within the interior of the coil 22. The panels 50 are generally configured so as to form chords of a circle. The generally stiff nature of the tubing 14 will cause the tubing to wrap around the panels 50 in a circular pattern, despite the planar nature of the panels 50. The arms 52 are illustrated as extending in a generally horizontal orientation. In this position, the arms 52 provide a containment area for the coil 22. The arms 52 also serve to limit the height of the coil 22. The specific configuration of the panels 50 and the arms 52 are shown in FIGS. 3 and 4 herein.

The turntable 26 can include a slot 54 formed through a surface thereof. The clamp 46 is illustrated as oriented adjacent to the slot 54. Ultimately, the end 44 of the tubing 14 can be introduced into and through the slot 54. Once the end 44 is introduced through the slot 54, the clamp 46 can be clamped thereon. The turntable 26 can then rotate so as to cause the formation of the coil 22.

The winch 30 is provided on a side of the turntable 26 opposite the levelwind 34 and the vise 38. A motor 58 is illustrated as cooperative with the winch 30. The winch 30 is particularly useful for drawing the coil 44 across the upper surface of the turntable 26. The winch 34 can be connected by a line to the end 44 of the tubing 14. As such, the winch 30 can facilitate the ability to place the end 44 of the tubing 14 within the slot 54. Once the end 44 is received within the slot 54 and the clamp 46 is clamped upon this end 44, a cutting tool can be used so as to separate the end 44 from the line extending to the winch 30. Under other circumstances, the fastener can be unbolted from the holes formed in the end 44 of the tubing 14 so as to allow the end 44 to remain free. It can be seen that as the turntable 26 will rotate in a clockwise direction, the tubing 14 will wrap around the panels 50 and within the constraints formed between the upper surface of the turntable 26 and the arms 52 so as to form the coil 22.

After the coil 22 has been formed, the arms 52 can be moved to a generally vertical orientation. Additionally, and as will be described hereinafter, the panels 50 will angularly incline inwardly so that the no longer exert any force upon the inner surface of the coil 22. As a result, it is relatively easy for a forklift to lift the coil 22 from the turntable 26. The coil 22 can then be delivered to the recycler or can the be delivered as scrap for delivered for disposal in a neat compact coil form.

FIG. 3 shows the coiling apparatus 20 of the present invention. In the coiling apparatus 20, the arms 52 are illustrated in their generally horizontal orientation. It can be seen that there is a base 24 having a plurality of struts 60 that serve to support the turntable 26 thereon. A suitable motor (not shown) can be provided so as to effectively rotate the turntable 26 relative to the base 24. The turntable 26 is illustrated as having shims or spacers 62 on a top surface thereof. The shims or spacers 62 facilitate the ability for the forks of a forklift to enter the space between the bottom of the coil 22 and the top surface of the turntable 26. As such, the bottom of the coil 22 will be slightly spaced from the top surface of the turntable 26. The turntable 26 further includes the slot 54 formed therein. Slot 54 has a width suitable for accommodating the diameter of the coil 14 therein. The top surface of the turntable 26 further includes coil supports 27 extending upwardly from the top surface of the turntable. The coil supports 27 will provide a spacing whereby the bottommost coil of the coil 22 will be slightly elevated above the flat top surface of the turntable 26. The clamp 46 is illustrated as positioned at the periphery of the turntable 26 adjacent to the slot 54. As such, once the tubing 14 has entered the slot 54 and extends outwardly therefrom, the clamp 46 can be closed so as to secure the end 44 of the tubing 14 within the slot 54. The turntable 26 will then be ready for rotation.

FIG. 3 shows that there are a plurality of panels 50 that extend vertically upwardly from the turntable 26. The panels 50 are configured in spaced relationship to each other. Panels 50 are generally of a curved configuration or a planar configuration so as to form chords or segments of a circle. An actuator 66 is located centrally of the turntable 26. Actuator 66 is cooperative with the arms 52. Arms 52 are pivotally connected adjacent to a top of each of the panels 52. In FIG. 3, the arms 52 are configured to extend horizontally outwardly from the center of the turntable 26. As a result, the arms 52 form a limiting area for the formation of the coil 22. Cams 68 are pivotally connected to the arms 52 and also have a surface that resides against the panels 50. As will be described hereinafter, as the panels 50 pivot inwardly so as to have an inwardly inclined orientation, the cams 68 will cooperate with the arms 52 so as to move the arms 52 into a substantially vertical orientation.

The levelwind 34 is supported upon a post 36. A structure 70 has horizontal beams 72 and 74 which support post 36. The levelwind 34 can move upwardly and downwardly along post 36 and also along post 76. The parallel arrangement of the posts 36 and 76 assure that the levelwind 34 is always in a proper orientation relative to the interior structure of the turntable 26. A pair of rollers 78 are mounted on the levelwind 34. As a result, the tubing 14 can extend between the pair of rollers 78. A weight 80 is illustrated as in an upper position. Weight 80 will bear against the tubing as it moves between the pair of rollers 78. A sensor 82 is provided so as to measure a length of tubing passing between the rollers 78 and onto the turntable 26. As such, the present invention effectively measures the length of tubing that is placed upon the turntable 26 and formed into the coil as the coil is being formed.

Winch 30 is illustrated as supported upon the base 24 and extending upwardly therefrom. Motor 58 is cooperative with the winch 30 so as to cause rotational movement of the winch 30.

FIG. 4 shows the apparatus 20 in which the arms 52 are illustrated in their substantially vertical orientation. It can be seen that the panels 50 are pivotally mounted at their bottoms to the turntable 26. In FIG. 4, the actuator 66 has been actuated so as to pivot the panels 50 from the generally vertical position to the angularly inwardly inclined position. The upper ends of each of the panels 50 will bear upon the cams 68. This will correspondingly cause the arms 52 to move to the substantially vertical orientation.

Typically, the panels 50 will move to their inwardly angularly inclined position after the coil 22 has been formed or during the formation of the coil 22. If the panels 54 are maintained in their vertical position during the formation of the coil 22, than the coil 22 will have a generally constant outer diameter. Importantly, when the panels 52 are moved angularly inwardly after the coil 22 has been formed, this will release any pressure or forces between the outer surfaces of the panels 50 and the inner surfaces of the coil 22. Additionally, the arms 52 are moved to the substantially vertical orientation. The outer diameter of the arms 52, when in the substantially vertical orientation, will be less than the inner diameter of the coil 22. As a result, a forklift can be introduced between the top surface of the turntable 26 and the bottom of the coil 22. The forklift can then lift the coil from the panels 50 and up and over the arms 52. The arms 52 can be lowered to the horizontal orientation and the panels 50 can be moved back to the vertical position so that another coil can be formed.

Figure 5:
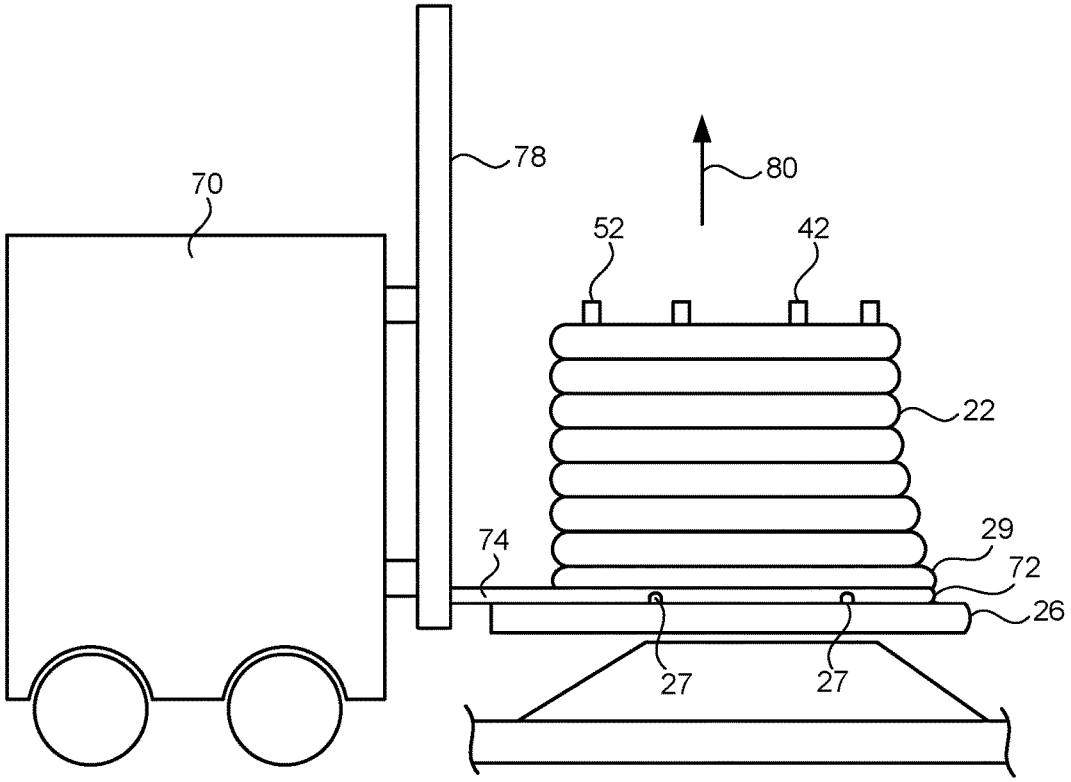
FIG. 5 is a side diagrammatic view showing the use of a forklift for the removal of the coil of scrap tubing from the turntable.

FIG. 5 illustrates how a forklift 70 can be manipulated so as to effectively with the coil 22 from the turntable 26. It can be seen that the coil 22 is wrapped around the arms 52. In particular, the spacers 27 will support the bottommost coil 29 a distance slightly above the top surface of the turntable 26. This space 72 should be greater than a thickness of the fork 74 of the forklift 70.

In FIG. 5, the forks 74 of the forklift 70 have been introduced into the space 72. As such, the forklift 70 can be moved toward the coil 22 so that the full reach of the forks 74 will underlie the bottommost coil 29. Once the upright 78 resides adjacent to the outer diameter of the coil 22, the forks 74 can move upwardly along the upright 78 so as to lift to the entire coil 22 upwardly and above the arms 52 in the manner illustrated by arrow 80.

Once the coil 22 is lifted, the forklift 70 can then, in one operation, move the coil 22 to a storage location or to a transport location.

Importantly, the forklift 70 of the present invention provides a number of unexpected advantages in the process and system of the present invention. First, because the system 10 is configured so as to allow the forklift 72 effectively insert the forks 74 beneath the coil 22, there is no need for a hoisting system. Typically, facilities that would develop such coils would require an indoor facility with hoisting systems incorporated into the building structure. As such, the hoist would be required so as to cause the coil 22 to initially move upwardly over the top of the arms 52. The hoist would then move along the building structure to a location such that the forklift 70 could further transport the coil 22. In the present invention, since only a single forklift 70 is employed for the lifting and movement of the coil 22, these complex hoisting systems, along with the expense associated therewith, is effectively avoided. Moreover, because these hoisting systems are not required in the system of the present invention, the system 10 can actually be utilized in an outdoor environment. As such, the present invention certainly minimizes the cost for the manufacture of the coil 22 of scrap tubing. Typically, most manufacturing facilities will easily have such forklift 70 available on-site. As such, it is not necessary to purchase additional capital equipment so as to effectively move and transport the coil 22. Other systems, such as those used for the manufacture of wire or small tubes, would typically the create coils that are too small to be manipulated by the forklift 70.

The foregoing disclosure and description of the invention is illustrative and explanatory thereof. Various changes in the details of the illustrated construction or the steps in the described method can be made within the scope of the present claims without departing from the true spirit of the invention. The present invention should only be limited by the following claims and their legal equivalents.

I claim:

1. A process for forming a coil of scrap tubing comprising:

forming a turntable having at least one longitudinal member extending upwardly therefrom, said at least one longitudinal member comprising a plurality of panels pivotally attached to and extending upwardly from said turntable and a plurality of arms respectively pivotally connected to upper ends of said plurality of panels;

supplying a reel of the scrap tubing to a location adjacent to said turntable;

extending an end of the scrap tubing toward said turntable;

fixing the end of the scrap tubing at said turntable;

rotating said turntable such that the scrap tubing wraps around said plurality of panels so as to form a coil;

pivoting said plurality of panels inwardly and said plurality of arms upwardly after said scrap tubing wraps around said plurality of panels, said plurality of arms being pivoted from a substantially horizontal orientation to a substantially vertical orientation by the pivoting of said plurality of panels;

clamping the scrap tubing in a fixed position;

cutting the scrap tubing so as to separate the coil of tubing from a remainder of the scrap tubing;

inserting a fork of a forklift into a space between said turntable and a bottom of the coil of scrap tubing such that the fork resides beneath the coil of the scrap tubing; and lifting the coil from said turntable and above said plurality of arms with said forklift after said plurality of arms are in the substantially vertical orientation.

2. The process of claim 1, further comprising:

moving said arm to the substantially horizontal orientation prior to the step of rotating.

3. The process of claim 1, further comprising:

extending the tubing through a levelwind, said levelwind positioned adjacent to said turntable; and moving said levelwind while said turntable rotates.

4. The process of claim 1, said turntable having a coil support extending upwardly therefrom, the step of rotating comprising:

initially rotating said turntable such that a bottom of the scrap tubing resides above a top of said turntable on said coil support.

* * * * *